US011236518B2

(12) United States Patent
Kawazoe

(10) Patent No.: US 11,236,518 B2
(45) Date of Patent: Feb. 1, 2022

(54) BINDING MACHINE

(71) Applicant: MAX CO., LTD., Tokyo (JP)

(72) Inventor: Akira Kawazoe, Tokyo (JP)

(73) Assignee: MAX CO., LTD., Tokyo (JP)

( * ) Notice: Subject to any disclaimer, the term of this patent is extended or adjusted under 35 U.S.C. 154(b) by 214 days.

(21) Appl. No.: 16/456,116

(22) Filed: Jun. 28, 2019

(65) Prior Publication Data

US 2020/0002962 A1 Jan. 2, 2020

(30) Foreign Application Priority Data

Jun. 29, 2018 (JP) ..... JP2018-125603

(51) Int. Cl.
*E04G 21/12* (2006.01)

(52) U.S. Cl.
CPC ..... *E04G 21/123* (2013.01)

(58) Field of Classification Search
CPC ..... E04G 21/123; E04G 21/12
USPC ..... 140/49, 57, 71 R, 73, 74, 93 A, 93 R, 140/93.2, 93.6, 111, 139, 149
See application file for complete search history.

(56) References Cited

U.S. PATENT DOCUMENTS

2006/0254666 A1* 11/2006 Kusakari ..... B65B 13/187 140/57
2009/0283167 A1* 11/2009 Nakagawa ..... E04G 21/123 140/111
2009/0283172 A1 11/2009 Itagaki
2014/0246115 A1 9/2014 Itagaki
2015/0048194 A1 2/2015 Itagaki
2015/0232212 A1 8/2015 Itagaki
2016/0186451 A1 6/2016 Itagaki
2016/0297555 A1 10/2016 Itagaki
2017/0218631 A1 8/2017 Matsuno
2017/0305584 A1 10/2017 Itagaki
2019/0002139 A1 1/2019 Itagaki
2019/0093374 A1 3/2019 Machida et al.

FOREIGN PATENT DOCUMENTS

JP 2013-144357 A 7/2013
JP 2017-110473 A 6/2017
WO 2017/199858 A1 11/2017

OTHER PUBLICATIONS

European Search Report issued in Application No. 19182923.3, dated Nov. 28, 2019, pp. 5.

* cited by examiner

*Primary Examiner* — Justin V Lewis
(74) *Attorney, Agent, or Firm* — Weihrouch IP

(57) ABSTRACT

A binding machine includes a reel accommodating portion, a reel brake, and a brake accommodating portion. The reel accommodating portion is configured to rotatably accommodate a wire reel. The reel brake has an engaging portion which is configured to engage with the wire reel and is configured to brake rotation of the wire reel. The brake accommodating portion covers a periphery of the reel brake except at least the engaging portion. The brake accommodating portion includes a first opening portion exposing the engaging portion and a second opening portion communicating with an outside.

17 Claims, 11 Drawing Sheets

BINDING MACHINE

CROSS-REFERENCE TO RELATED APPLICATIONS

This application is based on and claims priority to Japanese Patent Application No. 2018-125603 filed on Jun. 29, 2018, the disclosure of which is incorporated herein in its entirety by reference, and priority is claimed to the foregoing.

TECHNICAL FIELD

The present disclosure relates to a binding machine for binding a binding target material such as a reinforcing bar with a wire.

BACKGROUND ART

In recent years, there is a binding machine called a "reinforcing bar binding machine", in which a wire is wound around a plurality of reinforcing bars and the plurality of reinforcing bars are bound by twisting the wire.

In the related art, in this kind of reinforcing bar binding machine, a wire wound around a wire reel is fed toward a tip end side of a binding machine body by a feeding mechanism including a pair of feed gears and the like and the fed wire is curled by a curl guide provided on the tip end side of the binding machine body. In this case, the wire is curled so as to surround the reinforcing bars. When the wire is fed for a predetermined length, feeding of the wire is stopped, and then the wire is twisted by the twisting mechanism. When the wire is fed for the predetermined length, feeding of the wire is stopped, but the wire reel continues to rotate by inertia even after feeding of the wire is stopped. For this reason, the reinforcing bar binding machine is provided with a brake mechanism for stopping the rotation of the wire reel.

The brake mechanism includes a stopper lever which engages with the wire reel to stop the rotation of the wire reel, a driving unit such as a solenoid which drives the stopper lever, a shaft which connects the stopper lever and the driving unit, and the like. In the reinforcing bar binding machine of the related art, the stopper lever, the shaft, and the like (hereinafter simply referred to as a "stopper lever and the like") of the brake mechanism are provided so as to be exposed in a reel accommodating portion where the wire reel is accommodated (see, for example, JP-A-2013-144357).

SUMMARY OF INVENTION

In the configuration in which the stopper lever or the like is exposed to the reel accommodating portion, rainwater or the like easily adheres to the stopper lever or the like, which causes rust and is also a cause of operational failure. Here, in order to suppress that rainwater or the like adheres to the stopper lever or the like, it is conceivable to provide a brake accommodating portion including a wall portion or the like covering the periphery of the stopper lever or the like. However, by providing the brake accommodating portion, debris such as pieces of the wire reel may be accumulated in the brake accommodating portion, which may adversely affect a braking operation.

The present disclosure is made to solve such problems and an object thereof is to provide a binding machine which can discharge debris that enters a brake accommodating portion when the brake accommodating portion is provided to cover the periphery of a stopper lever or the like or a binding machine which prevents debris from entering a brake accommodating portion even when the brake accommodating portion is provided to cover the periphery of a stopper lever or the like.

According to one aspect of the disclosure, a binding machine includes a reel accommodating portion, a reel brake, and a brake accommodating portion. The reel accommodating portion is configured to rotatably accommodate a wire reel. The reel brake has an engaging portion which is configured to engage with the wire reel and is configured to brake rotation of the wire reel. The brake accommodating portion covers a periphery of the reel brake except at least the engaging portion. The brake accommodating portion includes a first opening portion exposing the engaging portion and a second opening portion communicating with an outside.

According to the disclosure, when foreign matter or the like generated by engagement of the engaging portion of the reel brake with the rotating wire reel and the generated foreign matter enters a brake accommodating portion, the entered foreign matter is discharged to the outside through the second opening portion.

According to another aspect of the disclosure, a binding machine includes a reel accommodating portion, a reel brake and a brake accommodating portion. The reel accommodating portion is configured to rotatably accommodate a wire reel. The reel brake has an engaging portion which is configured to engage with the wire reel and is configured to brake rotation of the wire reel. The brake accommodating portion covers a periphery of the reel brake. The brake accommodating portion includes a third opening portion provided on a moving path of the engaging portion and communicates the reel accommodating portion with the braking accommodating portion. The third opening portion includes a shielding portion which is configured to block the third opening portion in a state where the engaging portion engages with the wire reel.

According to the disclosure, when foreign matter or the like generated by engagement of the engaging portion of the reel brake with the rotating wire reel, the generated foreign matter is prevented from entering the brake accommodating portion through the third opening portion.

According to the disclosure, the foreign matter which enters the brake accommodating portion may be discharged to the outside, so the operability of the reel brake may be secured.

Further, according to the disclosure, it is possible to suppress the entry of the foreign matter into the brake accommodating portion through the third opening portion, so the operability of the reel brake may be secured.

DESCRIPTION OF EMBODIMENTS

Hereinafter, with reference to the drawings, an example of a reinforcing bar binding machine as an embodiment of a binding machine of the invention will be described.

Configuration Example of Reinforcing Bar Binding Machine of Embodiment

Figure 1:
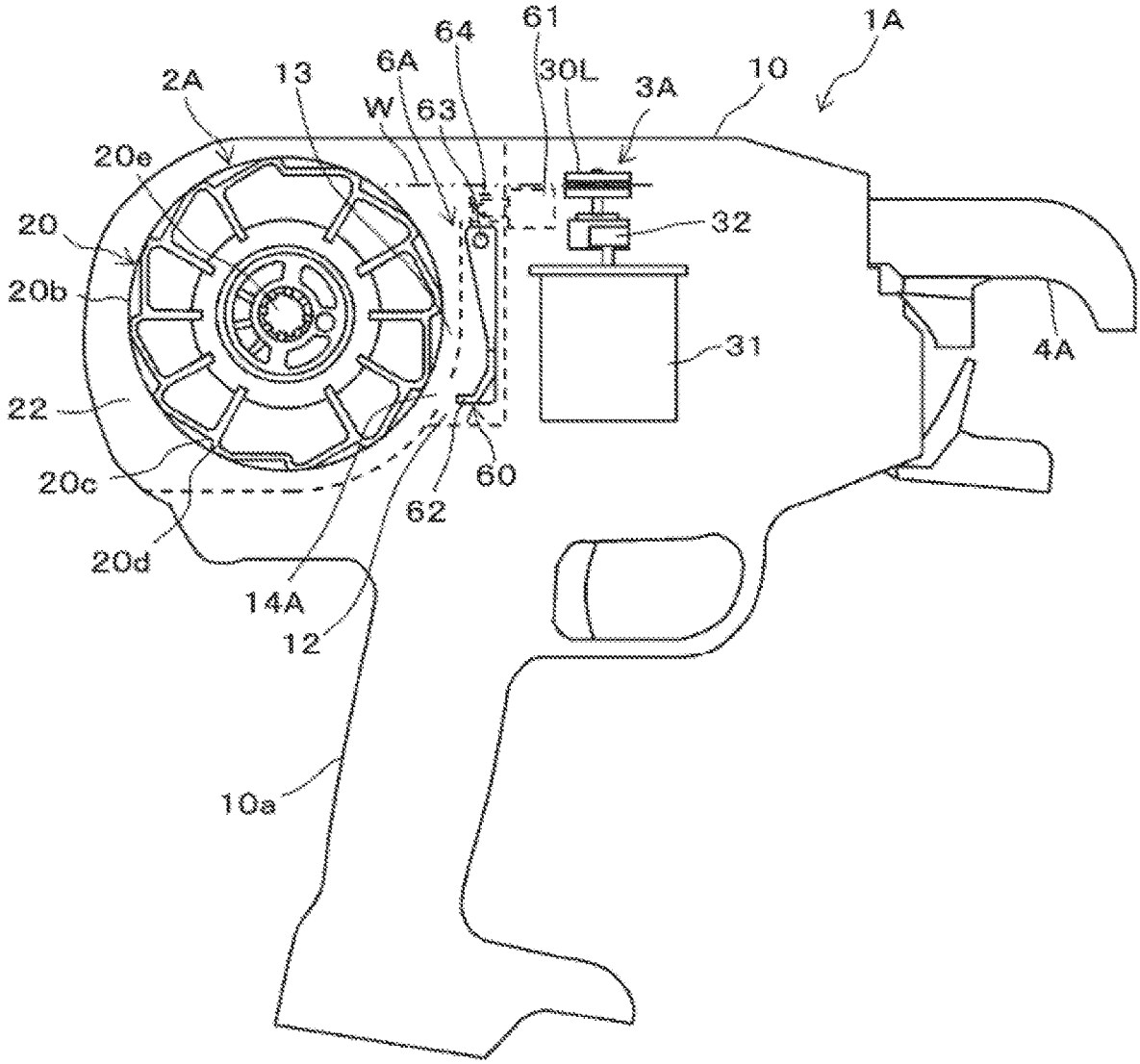
FIG. 1 is an overall configuration view seen from one lateral side illustrating an example of a reinforcing bar binding machine of an embodiment.
Figure 2:
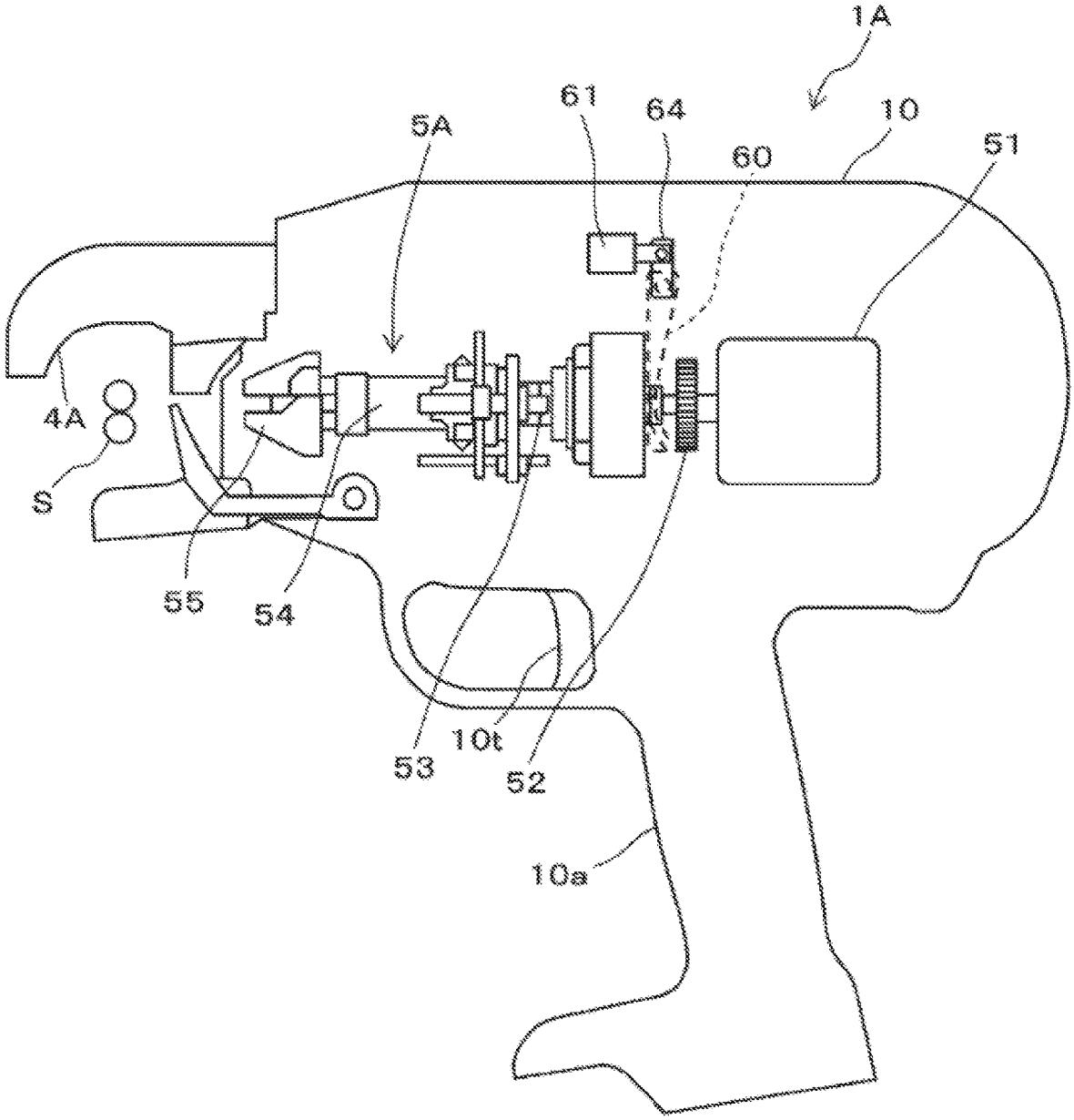
FIG. 2 is an overall configuration view seen from the other lateral side illustrating the example of the reinforcing bar binding machine of the embodiment.
Figure 3:
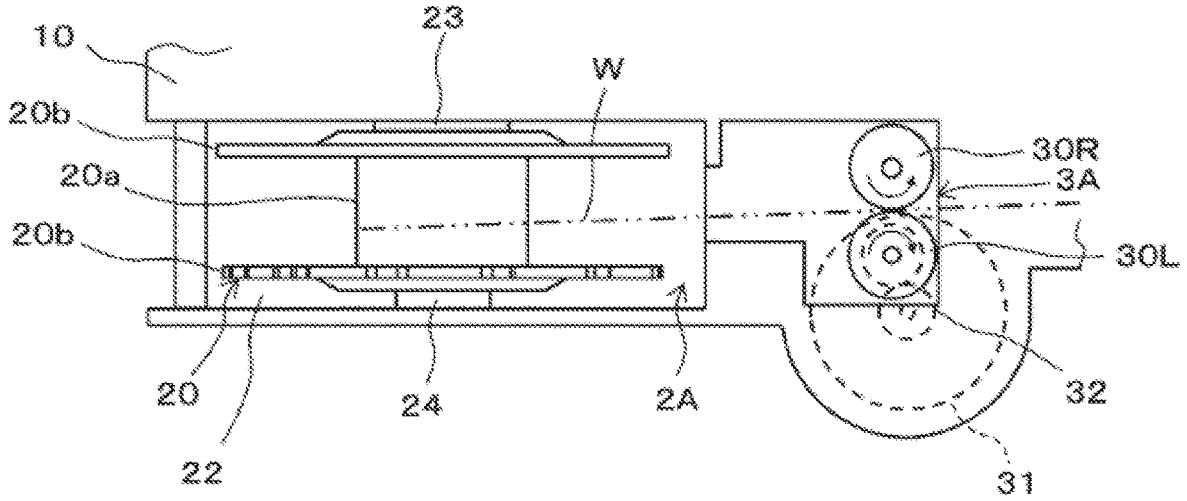
FIG. 3 is a configuration view of an essential part illustrating the example of the reinforcing bar binding machine of the embodiment as viewed from the top.

FIG. 1 is an overall configuration view seen from one lateral side illustrating an example of the reinforcing bar binding machine of an embodiment and FIG. 2 is an overall configuration view seen from the other lateral side illustrating the example of the reinforcing bar binding machine of the embodiment, and further, FIG. 3 is a configuration view of an essential part illustrating the example of the reinforcing bar binding machine of the embodiment as viewed from the top.

A reinforcing bar binding machine 1A includes a main body portion 10, a reel accommodating portion 2A which is formed in the main body portion 10 and which rotatably accommodates a wire reel 20 in which one or more wires are wound, and a wire feeding portion 3A which feeds a wire W wound around the wire reel 20 accommodated in the reel accommodating portion 2A. In addition, the reinforcing bar binding machine 1A includes a curl forming portion 4A which curls the wire W sent by the wire feeding portion 3A and winds the wire W around a reinforcing bar S, a binding portion 5A which twists the wire W wound around the reinforcing bar S, and a braking portion 6A which brakes the rotating wire reel 20 and restricts the rotation of the wire reel 20. Further, the reinforcing bar binding machine 1A includes a handle portion 10*a* protruding from the main body portion 10 and the handle portion 10*a* is provided with a trigger switch 10*t*. In the following description, a side on which the handle portion 10*a* is provided to the main body portion 10 of the reinforcing bar binding machine 1A is set as a lower side and the opposite side to the handle portion 10*a* is set as an upper side. A side on which the curl forming portion 4A is provided is set as a front side and a side on which the reel accommodating portion 2A is provided is set as a rear side.

First, the wire reel 20 used in the reinforcing bar binding machine 1A will be described with reference to FIGS. 1 and 3. The wire reel 20 includes a hub portion 20*a* having a cylindrical shape around which the wire W is wound and a pair of flange portions 20*b* provided on both axial end sides of the hub portion 20*a*. The flange portions 20*b* have a diameter larger than the diameter of the hub portion 20*a* and protrude further in a radial direction than both axial end sides of the hub portion 20*a*.

On an outer periphery of one flange portion 20*b*, a plurality of engaged portions 20*c* and protruding portions 20*d* are alternately formed in a substantially sawtooth shape along a circumferential direction. The wire reel 20 may stop the rotation by the engagement of a reel brake 60 of the braking portion 6A illustrated in FIG. 1 and the like with the engaged portion 20*c*. The engaged portion 20*c* and the protruding portion 20*d* may be formed in any shape, for example, in a concave-convex shape. As long as the reel brake 60 can be engaged and the engaged portion 20*c* and the protruding portion 20*d* are not necessarily limited to the sawtooth shape. In addition, the wire reel 20 is provided with hole portions 20*e* on both sides along an axial direction of the hub portion 20*a*.

Next, the reel accommodating portion 2A which accommodates the wire reel 20 will be described. The reel accommodating portion 2A includes a recess portion 22 formed in the main body portion 10. The recess portion 22 forms a space sized to accommodate all or part of the wire reel 20 or a chamber in which part or the entire of the periphery of the space is covered.

The reel accommodating portion 2A includes a first support shaft 23 protruding from a side wall surface of the recess portion 22 and rotatably supporting the wire reel 20 and a second support shaft 24 provided opposite to the first support shaft 23 and rotatably supporting the wire reel 20. The first support shaft 23 and the second support shaft 24 are fitted with the hole portions 20*e* of the wire reel 20 and rotatably support the wire reel 20.

One or both of the first support shaft 23 and the second support shaft 24 have a configuration which retracts the wire reel 20 from an inner portion of the reel accommodating portion 2A so that the wire reel 20 can be removed from the reel accommodating portion. In this example, the second support shaft 24 is configured to be retractable from the inner portion of the reel accommodating portion 2A.

Next, the wire feeding portion 3A which feeds the wire W will be described. The wire feeding portion 3A includes a pair of feed gears 30L and 30R. The pair of feed gears 30L and 30R are disposed across the feed path of the wire W, as illustrated in FIG. 3.

The feed gears 30L and 30R are, in this example, spur gears which have teeth formed on an outer peripheral surfaces thereof and groove portions which receives the wire W are formed along the circumferential direction. In the feed gears 30L and 30R, in a state where the wire W is received in the groove portions, the wire W is pinched between the feed gear 30L and the feed gear 30R and the teeth of the feed gear 30L and 30R mesh with each other.

The wire feeding portion 3A includes a feed motor 31 which drives the feed gear 30L and a gear 32 which transmits the rotation of the feed motor 31 to the feed gear 30L. When the rotation of the feed motor 31 is transmitted to the feed gear 30L through the gear 32, the feed gear 30R rotates in accordance with the feed gear 30L.

The wire feeding portion 3A sends the wire W toward the curl forming portion 4A by rotating the feed gears 30L and 30R in a state where the wire W is pinched between the feed gear 30L and the feed gear 30R.

Next, the curl forming portion 4A which causes the wire W to be wound around the reinforcing bar S will be described. The curl forming portion 4A abuts on the wire W sent by the wire feeding portion 3A and regulates an advancing direction of the wire W. The curl forming portion 4A regulates the advancing direction of the wire W so that the wire W has a substantially circular shape around the reinforcing bar S and curls the wire W (curling the wire W).

Next, the binding portion 5A which twists the wire W and binds the reinforcing bars S will be described. The binding portion 5A includes a torsion motor 51, a gear 52, a screw shaft portion 53, an advancing and retracting cylinder portion 54, and a torsion hook 55. The torsion motor 51 drives the binding portion 5A, as a drive source separately from the feed motor 31.

The screw shaft portion 53 is formed with a thread on an outer peripheral surface thereof and is rotated by the driving force of the torque motor 51 transmitted through the gear 52. A thread is formed on an inner peripheral surface of the advancing and retracting cylinder portion 54 and it meshes with the thread on the outer peripheral surface of the screw shaft portion 53.

The advancing and retracting cylinder portion 54 moves back and forth by rotation of the screw shaft portion 53 by rotation of the torque motor 51 in a state where the rotation of the advancing and retracting cylinder portion 54 is restricted. In addition, the advancing and retracting cylinder portion 54 is to be coupled to rotate integrally with screw shaft portion 53 so as to be rotated by the rotation of the screw shaft portion 53 by the rotation of torque motor 51.

The torsion hook 55 is a pair of claw members attached to a tip end of the advancing and retracting cylinder portion 54. The torsion hook 55 is to be opened or closed in accordance with the advancing and retracting operation of the advancing and retracting cylinder portion 54.

Next, the braking portion 6A which stops the rotation of the wire reel 20 will be described. The braking portion 6A includes a reel brake 60 engageable with the wire reel 20, a solenoid 61 which drives the reel brake 60, and a shaft 63 connecting the reel brake 60 and the solenoid 61. The solenoid 61 is connected to the shaft 63 via a link 64. The reel brake 60 includes an engaging portion 62 engaged with the engaged portion 20*c* of the wire reel 20 at one end of the reel brake 60 and a connecting portion which is connected to the shaft 63 at the other end of the reel brake 60.

The solenoid 61 has a solenoid body and an iron core. The iron core is drawn into or pushed out with respect to the solenoid body by energization. When the iron core moves by energization, the shaft 63 is to rotate via the link 64 and the rotation of the shaft 63 causes the reel brake 60 to rotate in the same direction as the rotation direction of the shaft 63.

The reel brake 60 has a substantially L shape when viewed from the side of the main body portion 10 and has a reel brake main body portion extending downward from the connecting portion by a predetermined length and an extending portion formed to be bent from the reel brake main body portion toward the reel accommodating portion 2A side. The engaging portion 62 is formed in the extending portion, includes at least a portion engaged with the engaged portion 20*c* of the wire reel 20, and is formed on the one end side of the reel brake 60. The engaging portion 62 moves between a braking position, which is the first position where the engaging portion 62 is engaged with the engaged portion 20*c* of the wire reel 20, and a retracted position, which is the second position where the engaging portion 62 is away from the engaged portion 20*c* of the wire reel 20 and disconnected therefrom, with rotational movement around the shaft 63.

The wire reel 20 rotates in accordance with the feeding of the wire W by the wire feeding portion 3A. However, the wire reel 20 continues to rotate by inertia even after the wire feeding portion 3A stops feeding the wire W.

Therefore, in conjunction with the wire feeding portion 3A stopping the feeding of the wire W, the braking portion 6A is operated and the rotation of the wire reel 20 is stopped. Specifically, in conjunction with the wire feeding portion 3A stopping the feeding of the wire W, the solenoid 61 is energized and the reel brake 60 is moved (rotated), and then the engaging portion 62 is moved from the retracted position to the braking position. As a result, the engaging portion 62 engages with the engaged portion 20*c* of the wire reel 20, and thus the rotation of the wire reel 20 stops.

Figure 4:
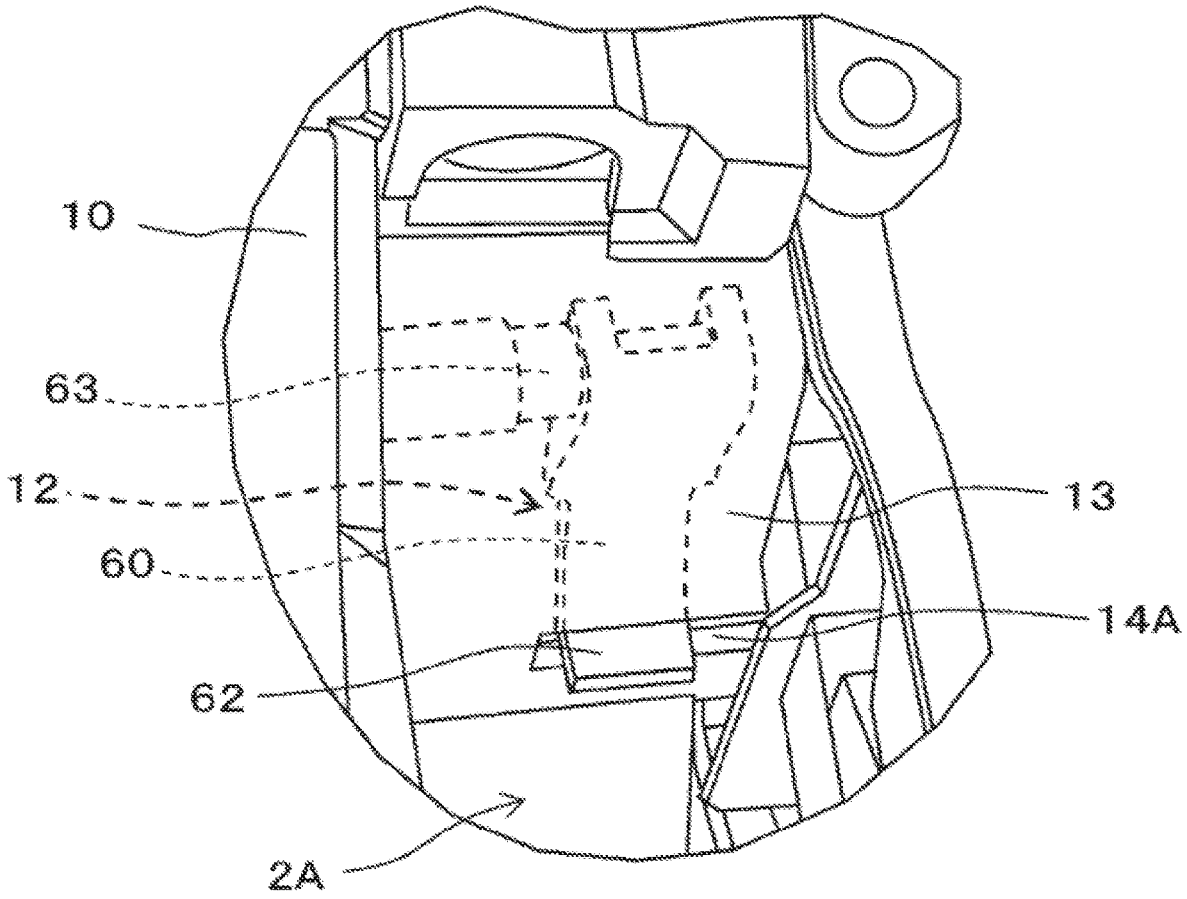
FIG. 4 is a perspective view of an essential part illustrating an example of a brake accommodating portion.

FIG. 4 is a perspective view of an essential part illustrating an example of a brake accommodating portion. The brake accommodating portion 12 is provided adjacent to the reel accommodating portion 2A. The brake accommodating part 12 includes a wall portion 13 which covers a surroundings of the reel brake 60 except for a part facing a tip end portion of the engaging part 62 of the reel brake 60. In addition, the embodiment includes not only a case where the entire of the reel brake 60 is covered except for the part facing the tip end portion of the engaging part 62, but also a case where only a part of the reel brake 60 is covered. It is necessary to cover at least the connecting portion between the reel brake 60 and the shaft 63.

The brake accommodating portion 12 includes a first opening portion 14A which exposes the engaging portion 62 of the reel brake 60 and which makes the engaging portion 62 protrude toward the rear accommodating portion 2A or which makes the engaging portion 62 retracted into the braking accommodating portion 12. The first opening portion 14A includes a hole having a predetermined shape penetrating the wall portion 13 in accordance with the locus of the engaging portion 62 moved by the rotational movement of the reel brake 60 around the shaft 63.

When the engaging portion 62 is moved to the braking position, the engaging portion 62 protrudes from the first opening portion 14A to a position where the engaging portion 62 engages with the engaged portion 20*c* of the wire reel 20 in the reel accommodating portion 2A. Also, when the engaging portion 62 is moved to the retracted position, the engaging portion 62 retracts from the first opening portion 14A into the brake accommodating portion 12. In a state where the engaging portion 62 is moved to the retracted position, the engaging portion 62 may protrude, from the first opening portion 14A into the reel accommodating portion 2A, to a position where the engaging portion 62 is away from the engaged portion 20*c* of the wire reel 20 and disconnected therefrom. As described above, the first opening portion 14A exposing the engaging portion 62 of the reel brake 60 includes not only a configuration in which, when the engaging portion 62 is moved to the retracted position, the engaging portion 62 is retracted from the first opening portion 14A into the brake accommodating portion 12, but also a configuration in which the engaging portion 62 protrudes, from the first opening portion 14A to the reel accommodating portion 2A, to a position where the engaging portion 62 is away from the engaged portion 20*c* of the wire reel 20 and disconnected therefrom.

Operation Example of Reinforcing Bar Binding Machine of Embodiment

Next, with reference to the drawings, an operation of binding the reinforcing bars S using the wire W in the reinforcing bar binding machine 1A of the embodiment will be described.

When the trigger switch 10*t* is operated, the feed motor 31 is driven and the wire W is sent by a predetermined amount by the wire feeding portion 3A. The wire W sent by the wire feeding portion 3A is wound around the reinforcing bar S by the curl forming portion 4A. Based on the feed amount of wire W, the number of times of the wire W is set to wind the wire W around the reinforcing bar S. The wire reel 20 rotates in accordance with the feeding of the wire W sent by the wire feeding portion 3A. When the wire W is sent by a predetermined amount, the wire feeding portion 3A finishes the feeding operation of the wire W, but the wire reel 20 is going to continue rotating by inertia, so the rotation of the wire reel is braked by the braking portion 6A. After the feeding operation of the wire W by the wire feeding portion 3A is finished by stopping the feed motor 31, the rotation of the wire reel 20 is regulated by braking the wire reel 20 rotating in accordance with the feeding of the wire W with the braking portion 6A.

In the binding portion 5A, the torsion motor 51 rotates forward and the rotation of the torsion motor 51 is transmitted to the screw shaft portion 53 via the gear 52. In this case, the screw shaft portion 53 is rotated, but since the rotation is restricted in the advancing and retracting cylinder portion 54, the advancing and retracting cylinder portion 54 is sent forward by the action of the screw-engaged thread. As the advancing and retracting cylinder portion 54 is sent forward, the torsion hook 55 advances to a position where the torsion hook 55 comes into contact with the wire W. The torsion hook 55 operates in the closing direction in conjunction with the advancement of the advancing and retracting cylinder portion 54 and grips a part of the wire wound in a loop shape.

The restriction in the rotation of the advancing and retracting cylinder portion 54 is released at a predetermined advanced position and the advancing and retracting cylinder portion 54 rotates with the screw shaft portion 53. The wire W is twisted by rotating the torsion hook 55 gripping the wire W. While the advancing and retracting cylinder portion 54 advances, a cutter (not illustrated) operates to cut the wire W.

When the twisting operation is finished, the torsion motor 51 reverses and the screw shaft portion 53 rotates in a reverse direction. As a result, the advancing and retracting cylinder portion 54 and the torsion hook 55 also move backward and the torsion hook 55 opens to release the wire W. The torsion motor 51 reverses until the advancing and retracting cylinder portion 54 and the torsion hook 55 move to a standby position. When the advancing and retracting cylinder portion 54 and the torsion hook 55 move to the standby position, the torsion motor 51 is stopped to finish a series of operations. Therefore, the reinforcing bars S are bound by the wire W.

Example of Brake Accommodating Portion of First Embodiment

FIGS. 5, 6A, 6B, 7A, 7B, 8A, 8B, and 9 are views illustrating an example of a brake accommodating portion of a first embodiment provided in the reinforcing bar binding machine of the embodiment. In the brake accommodating portion 12 (12A1 to 12A5) of each example of the first embodiment, foreign matter Du which enters from the first opening portion 14A to the brake accommodating portion 12 (12A1 to 12A5) is removed through a second opening (68A1 to 68A5).

Figure 5:
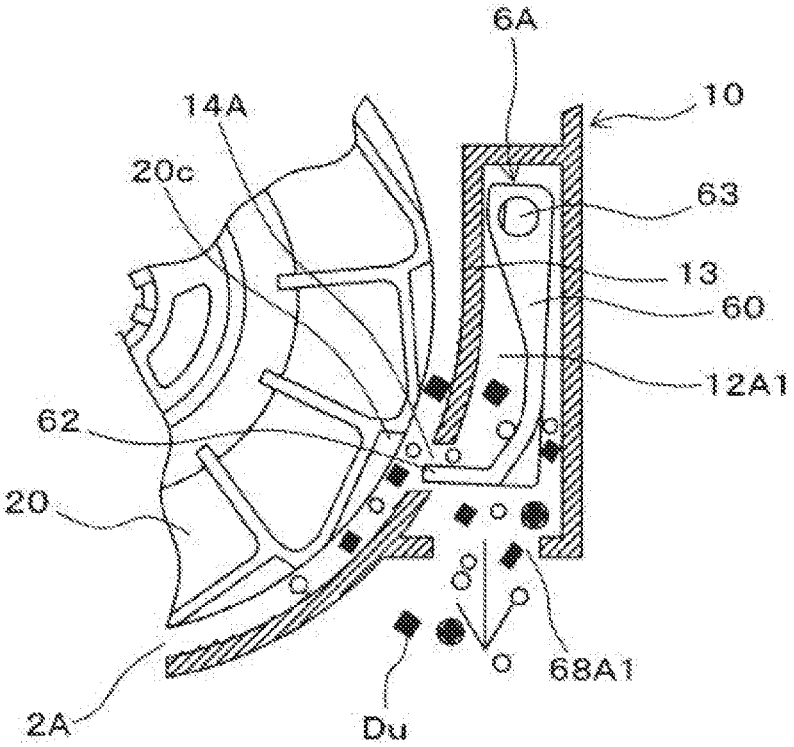
FIG. 5 is a view illustrating an example of a brake accommodating portion of a first embodiment provided in the reinforcing bar binding machine of the embodiment.

As illustrated in FIG. 5, the brake accommodating portion 12A1 according to the first example of the first embodiment includes the second opening portion 68A1 which communicates the inside of the brake accommodating portion 12A1 with the outside of the brake accommodating portion 12A1 excluding the reel accommodating portion 2A. The second opening portion 68A1 has an opening of a size that can discharge the foreign matter Du. The second opening portion 68A1 is provided below the brake accommodating portion 12, which is the same direction as the handle portion 10*a* protrudes from the main body portion 10.

In the reinforcing bar binding machine 1A, when the engaging portion 62 of the reel 60 is engaged with the engaged portion 20*c* of the rotating wire reel 20, the wire reel 20 may be scraped by the reel brake 60 or the reel brake 60 may be scraped by the wire reel 20. When the wire reel 20 or the reel brake 60 is scraped, the scraped piece may be a foreign matter and may remain in the reel accommodating portion 2A. Further, when the wire W is coated, the coating may be peeled off to be a foreign matter. Also, when a surface of the wire W is oxidized, the oxide may be peeled off to be a foreign matter. As the wire reel 20 rotates, the wire reel 20 may be scraped by the first support shaft 23 and the second support shaft 24 illustrated in FIG. 3 to be a foreign matter. In the operation of attaching or removing the wire reel 20 to or from the reel accommodating portion 2A, foreign matter may enter the reel accommodating portion 2A from the outside.

Figure 10:
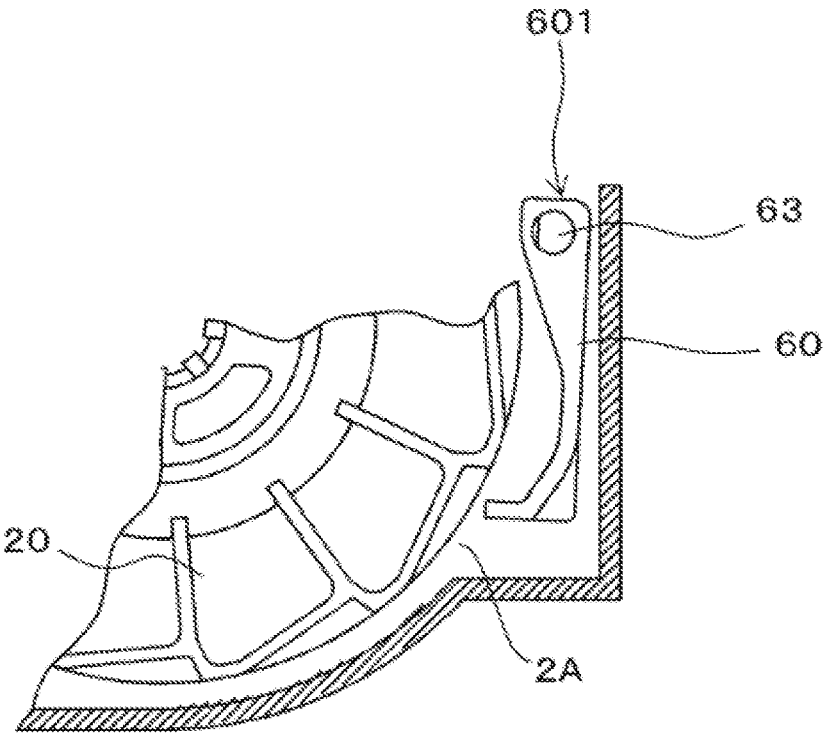
FIG. 10 is a view illustrating a braking portion of the related art.
Figure 11:
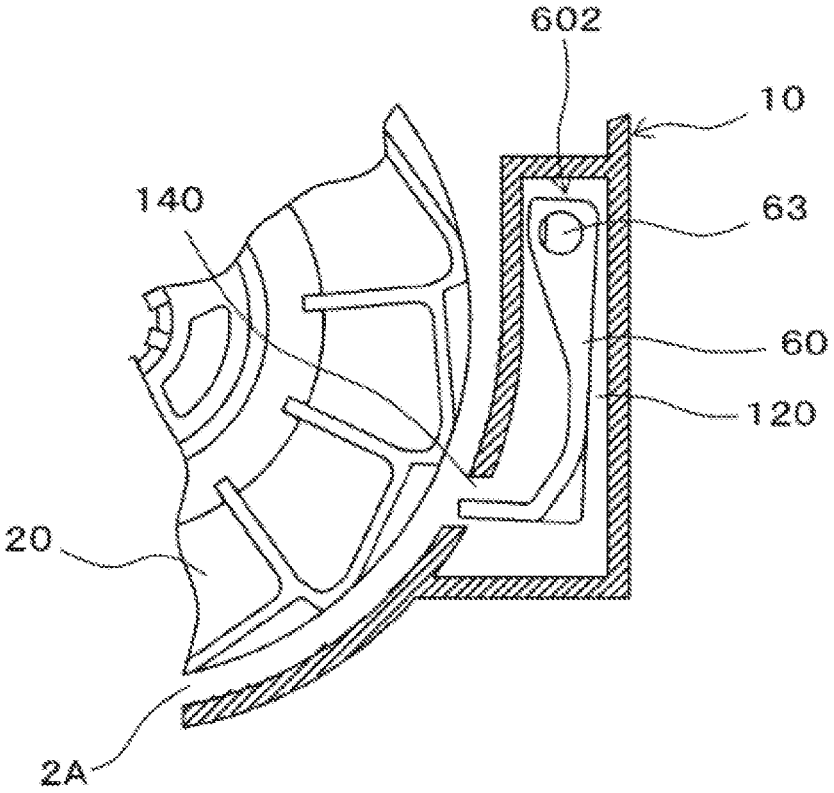
FIG. 11 is a view illustrating a braking portion of the related art.
Figure 12:
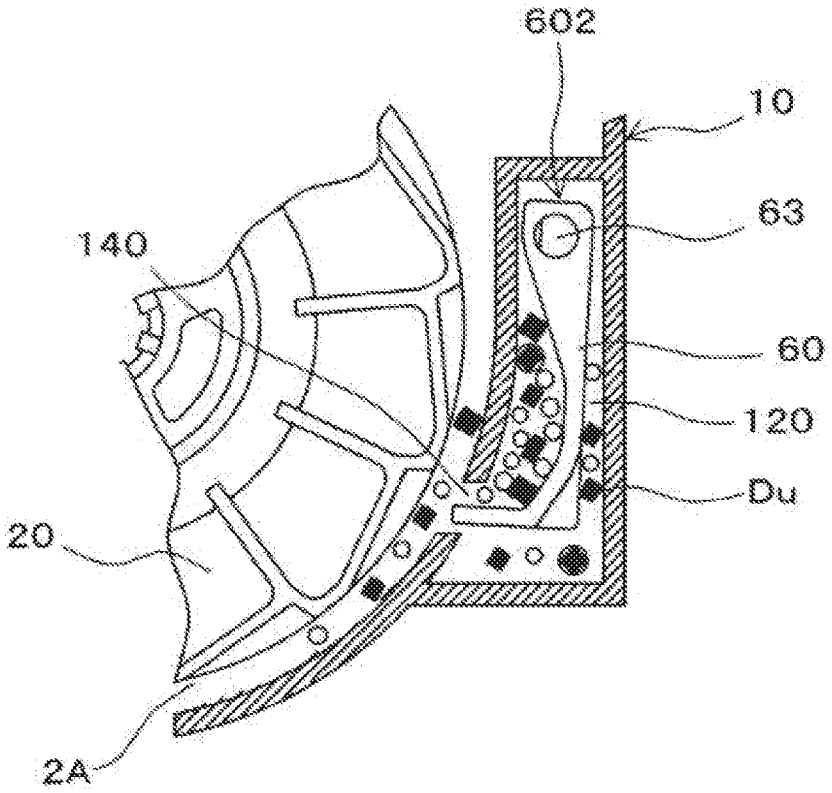
FIG. 12 is a view illustrating a braking portion of the related art.

FIGS. 10 to 12 are views illustrating braking portions of the related art. A braking portion 601 of the related art illustrated in FIG. 10 has a configuration in which the reel brake 60 is exposed to the reel accommodating portion 2A. In such a configuration, moisture due to rainwater or the like enters a portion supporting the shaft 63 and rusting occurs on metal parts, so operational failure may occur in the reel brake 60.

In order to solve such a problem, it is conceivable to cover the reel brake 60 with a brake accommodating portion 120 as illustrated in FIG. 11. However, in such a configuration, as illustrated in FIG. 12, there is a new problem that the foreign matter Du which has entered the brake accommodating portion 120 from an opening portion 140 may accumulate in the braking accommodating portion 120 and cause operational failure of the reel brake 60.

Here, in the brake accommodating portion 12A1 of the first example of the first embodiment, a second opening portion 68A1 communicating the inside and the outside of the brake accommodating portion 12A1 is provided. Therefore, the example can discharge, to the outside of the brake accommodating portion 12A1 through the second opening portion 68A1, the foreign matter Du which is generated in the reel accommodating portion 2A and enters the brake accommodating portion 12A1 through the first opening portion 14A or the foreign matter Du or the like which enters the reel accommodating portion 2A from outside and enters the brake accommodating portion 12A1 through the first opening portion 14A. As a result, the accumulation of the foreign matter Du or the like in the brake accommodating portion 12A1 is suppressed, and thus the occurrence of operational failure can be suppressed in the reel brake 60.

Since the second opening portion 68A1 is provided below the brake accommodating portion 12A1, which is the same direction as the direction in which the handle portion 10*a* protrudes from the main body portion 10, the foreign matter Du can be discharged from the second opening portion 68A1 to the outside of the brake accommodating portion 12A1 by its own weight when carrying out the operation of binding the reinforcing bars S with holding the handle portion 10*a*.

Figure 6A:
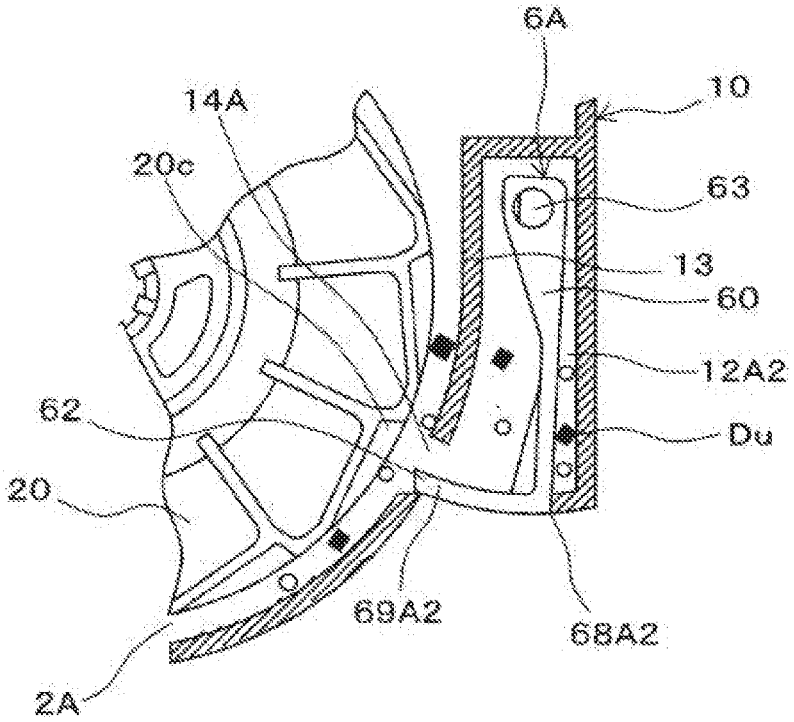
FIG. 6A is a view illustrating an example of a brake accommodating portion of the first embodiment provided in the reinforcing bar binding machine of the embodiment.
Figure 6B:
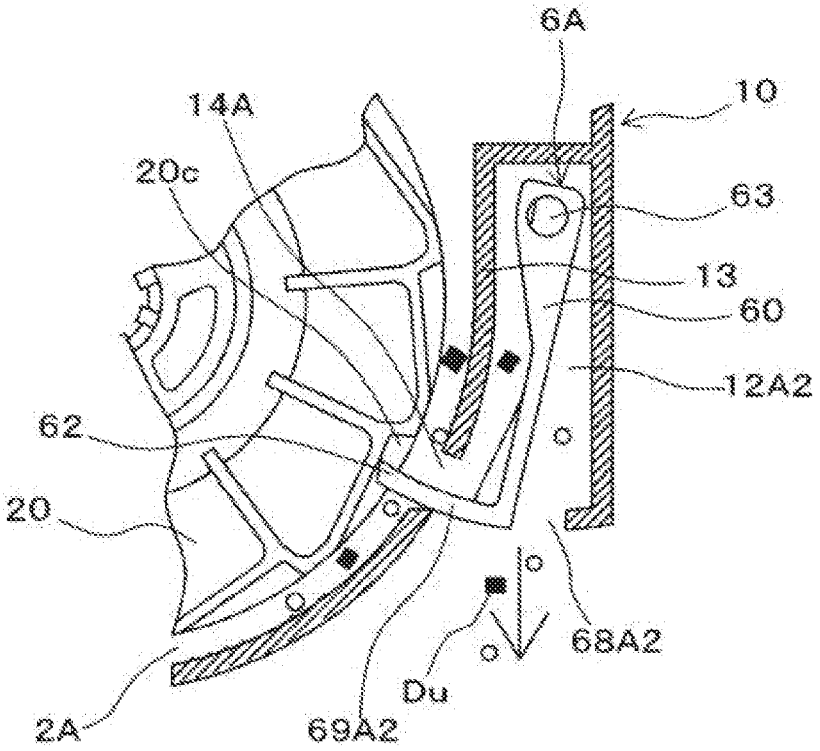
FIG. 6B is a view illustrating the example of the brake accommodating portion of the first embodiment provided in the reinforcing bar binding machine of the embodiment.

As illustrated in FIGS. 6A and 6B, the brake accommodating portion 12A2 of a second example of the first embodiment includes a second opening portion 68A2 which communicates the inside and the outside of the brake accommodating portion 12A2. The second opening portion 68A2 has an opening of a size that can discharge the foreign matter Du.

A lid portion 69A2 is provided on the reel brake 60, and as illustrated in FIG. 6A, an extension portion of the lid portion 69A2 closes the second opening portion 68A2 when the reel brake 60 is moved to the retracted position, which is the second position. The lid portion 69A2 has an outer shape capable of blocking the second opening portion 68A2 at a position where the lid portion 69A2 closes the second opening portion 68A2. As illustrated in FIG. 6B, the lid portion 69A2 retracts from the second opening portion 68A2 when the reel brake 60 moves to the braking position, which is the first position.

As illustrated in FIG. 6A, when the reel brake 60 moves to the retracting position, the engaging portion 62 of the braking portion 6A retracts into the first opening portion 14A. Also, as illustrated in FIG. 6B, when the reel brake 60 moves to the braking position, the engaging portion 62 protrudes from the first opening portion 14A into the reel accommodating portion 2A and engages with the engaged portion 20*c* of the wire reel 20.

The brake accommodating portion 12A2 of the second example of the first embodiment includes the second opening portion 68A2 which communicates the inside and the outside of the brake accommodating portion 12A2 and includes the lid portion 69A2 which opens or closes the second opening portion 68A2 in the reel brake 60. Therefore, the foreign matter Du, moisture, or the like which enters the brake accommodation portion 12A2 through the first opening portion 14A can be discharged outside the brake accommodation making portion 12A2 by opening the lid portion 69A2 by moving the reel brake 60 to the braking position, as illustrated in FIG. 6B.

As a result, the accumulation of the foreign matter Du or the like in the inside of the brake accommodating portion 12A2 is suppressed, and thus the occurrence of the operational failure of the reel brake 60 can be suppressed. In addition, since the second opening portion 68A2 can be open or closed by the operation of the reel brake 60, the foreign matter can be discharged for each binding operation, and thus accumulation of the foreign matter in the brake accommodating portion 12A2 can be suppressed. A user may place the main body portion 10 on the ground with the top surface down. Therefore, when the second opening portion 68A2 is provided below the main body portion 10, dust and rain water can easily enter through the second opening portion 68A2. Therefore, by providing the lid portion 69A2, dust, rain water, or the like can be prevented from entering the inside of the brake accommodating portion 12A.

Figure 7A:
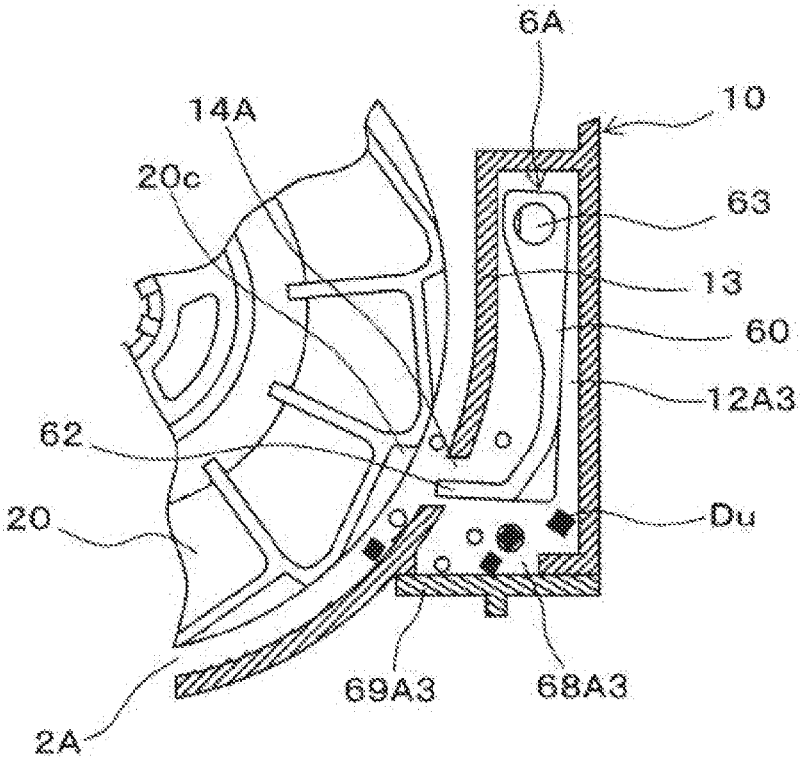
FIG. 7A is a view illustrating an example of the brake accommodating portion of the first embodiment provided in the reinforcing bar binding machine of the embodiment.
Figure 7B:
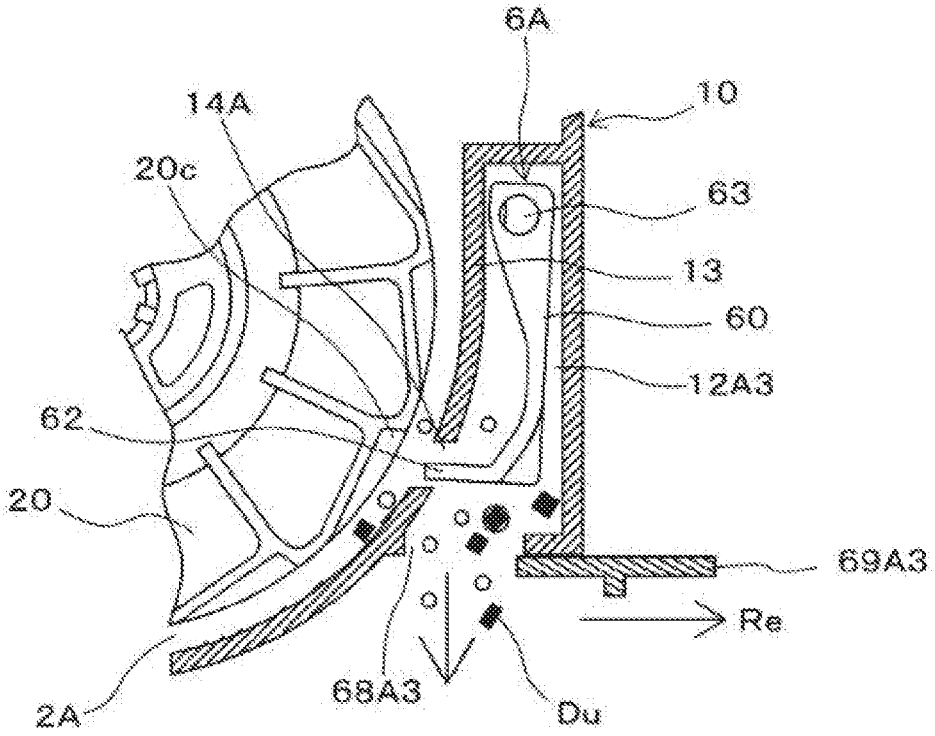
FIG. 7B is a view illustrating the example of the brake accommodating portion of the first embodiment provided in the reinforcing bar binding machine of the embodiment.

As illustrated in FIGS. 7A and 7B, the brake accommodating portion 12A3 of a third example of the first embodiment includes a second opening portion 68A3 which communicates the inside and the outside of the brake accommodating portion 12A3. The second opening portion 68A3 has an opening of a size which can discharge the foreign matter Du. The brake accommodating portion 12A3 includes a lid portion 69A3 which opens or closes the second opening portion 68A3.

As illustrated in FIG. 7A, the lid portion 69A3 has an outer shape capable of blocking the second opening portion 68A3 at a position where the lid portion 69A3 closes the second opening portion 68A3. Further, as illustrated in FIG. 7B, the lid portion 69A3 is configured to provide with a movable member or an attachable and detachable member with respect to the main body portion 10 as indicated by the arrow Re from the second opening portion 68A3 to a position to be retracted.

The brake accommodating portion 12A3 of the third example of the first embodiment includes the second opening portion 68A3 which communicates the inside and the outside of the brake accommodating portion 12A3 and the lid portion 69A3 which opens or closes the second opening portion 68A3. Therefore, the foreign matter Du, moisture, or the like which enters the brake accommodation portion 12A3 through the first opening portion 14A can be discharged outside the brake accommodation making portion 12A3 through the second opening portion 68A3 by opening the lid portion 69A3 as needed as illustrated in FIG. 7B. As a result, the accumulation of the foreign matter Du or the like in the inside of the brake accommodating portion 12 is suppressed, and thus the occurrence of the operational failure of the reel brake 60 can be suppressed. A user may place the main body portion 10 on the ground with the top surface down. Therefore, when the second opening portion 68A3 is provided below the main body portion 10, dust and rain water can easily enter through the second opening portion 68A3. Therefore, by providing the lid portion 69A3, dust, rain water, or the like can be prevented from entering the inside of the brake accommodating portion 12A.

Figure 8A:
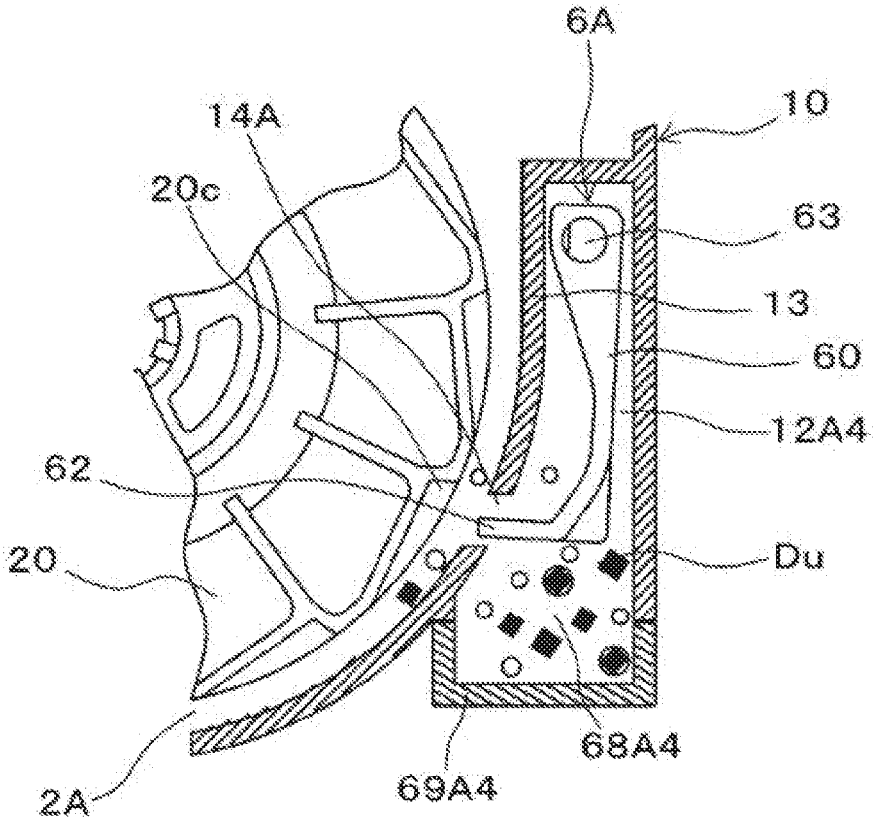
FIG. 8A is a view illustrating an example of the brake accommodating portion of the first embodiment provided in the reinforcing bar binding machine of the embodiment.
Figure 8B:
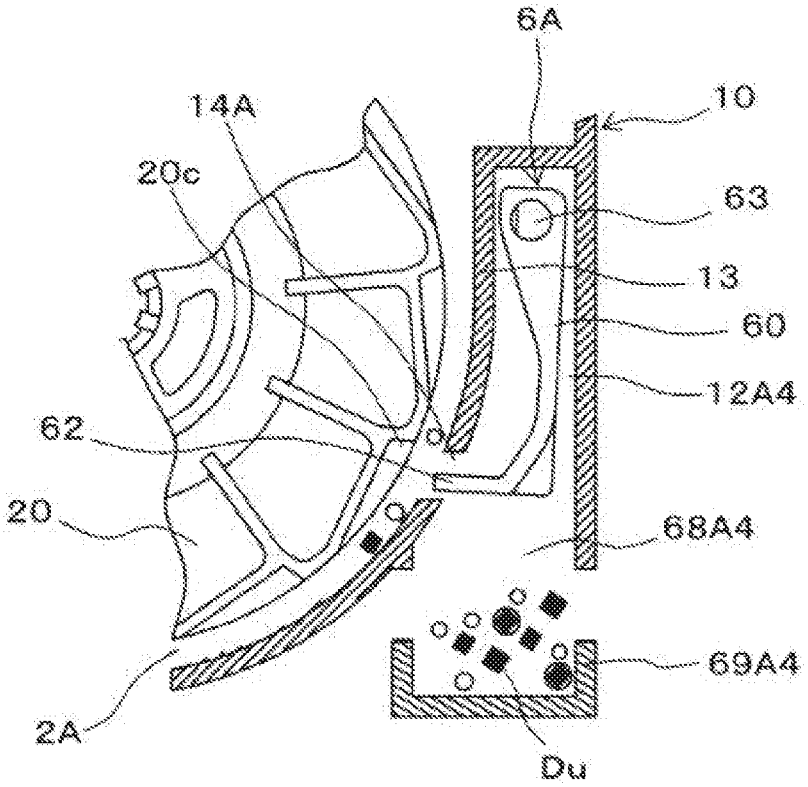
FIG. 8B is a view illustrating the example of the brake accommodating portion of the first embodiment provided in the reinforcing bar binding machine of the embodiment.

As illustrated in FIGS. 8A and 8B, a brake accommodating portion 12A4 of a fourth example of the first embodiment includes a second opening portion 68A4 which communicates the inside and the outside of the brake accommodating portion 12A4. The second opening portion 68A4 has an opening of a size which can discharge the foreign matter Du. The brake accommodating portion 12A4 includes a storage portion 69A4 that opens and closes the second opening portion 68A4.

As an example of the lid portion formed in a concave shape capable of accommodating the foreign matter Du, the storage portion 69A4 has an outer shape capable of blocking the second opening portion 68A4 at a position where the storage portion 69A4 closes the second opening portion 68A4, as illustrated in FIG. 8A. As illustrated in FIG. 8B, the storage portion 69A4 provides with a member which is attachable to and detachable from the second opening portion 68A4.

The brake accommodating portion 12A4 of the fourth example of the first embodiment includes the second opening portion 68A4 which communicates the inside and the outside of the brake accommodating portion 12A4 and the storage portion 69A4 attachable to and detachable from the second opening portion 68A4. Therefore, the foreign matter Du, moisture, or the like which enters the brake accommodation portion 12A4 through the first opening portion 14A can be accumulated in the storage portion 69A4, as illustrated in FIG. 8A, and discharged by removing the storage portion 69A4 as needed, as illustrated in FIG. 8B.

As a result, the accumulation of the foreign matter Du or the like inside the brake accommodating portion 12A4 is suppressed, and thus the occurrence of the operational failure of the reel brake 60 can be suppressed. In addition, the foreign matter is accumulated in the storage portion 69A4 and the accumulated matter can be discharged to the outside of the brake accommodating portion 12A4 by removing the storage portion 69A4 from the second opening portion 68A4. Therefore, the foreign matter can be easily discharged to the outside.

Figure 9:
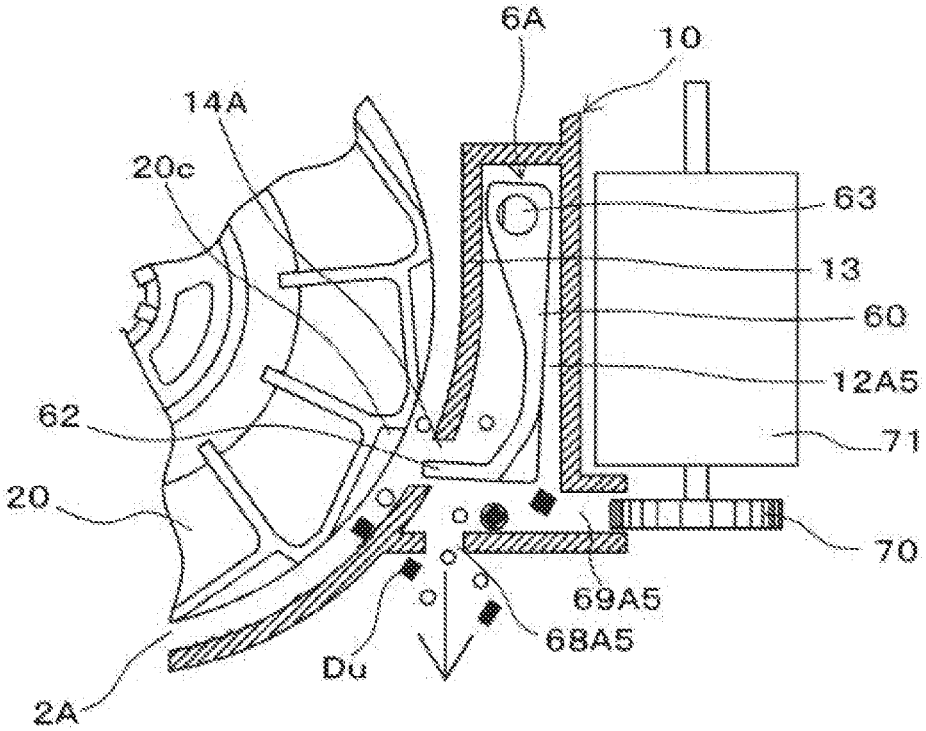
FIG. 9 is a view illustrating an example of the brake accommodating portion of the first embodiment provided in the reinforcing bar binding machine of the embodiment.

As illustrated in FIG. 9, a brake accommodating portion 12A5 of a fifth example of the first embodiment includes a second opening portion 68A5 which communicates the inside and the outside of the brake accommodating portion 12A5.

The second opening portion 68A5 has an opening of a size which can discharge the foreign matter Du. The main body portion 10 has a fan 70 at a position adjacent to the brake accommodating portion 12A5. The fan 70 is driven by the feed motor 31 in this example. The brake accommodating portion 12A5 is provided with an air inlet 69A5 in communication with the fan 70 and an air passage is formed so as to be extended from the inlet 69A5, to pass through the brake accommodating portion 12A5, and to be connected to the second opening portion 68A5.

In the brake accommodating portion 12A5 of the fifth example of the first embodiment, when the fan 70 rotates by the operation for sending the wire W, a flow of air blown out from the second opening portion 68A5 is generated to discharge foreign matter Du, moisture, or the like which enters the brake accommodating portion 12A5 through the first opening portion 14A, to the outside of the brake accommodating portion 12A5 through the second opening portion 68A5 by the air flow.

As a result, the accumulation of the foreign matter Du or the like in the brake accommodating portion 12A5 is suppressed, and thus the occurrence of the operational failure of the reel brake 60 can be suppressed. While the fan 70 is provided at a position adjacent to the brake accommodating portion 12A5 in this example, the fan 70 may be provided in the brake accommodating portion 12A5. In this case, an air passage is formed which leads from the brake accommodating portion 12A5 to the second opening portion 68A5 without passing through the inlet 69A5. In this example, the fan 70 is configured to be driven by the feed motor 31, but may be configured to include a dedicated motor to drive the fan 70.

Example of Brake Accommodating Portion of Second Embodiment

FIGS. 13 to 16 are configuration diagrams illustrating an example of a brake accommodating portion of a second embodiment provided in the reinforcing bar binding machine of the embodiment. In the brake accommodating portion 12 (12B1 to 12B4) of each example of the second embodiment, the embodiment prevents an entry of the foreign matter Du into the brake accommodating portion 12 through a third opening 14B communicating the reel accommodating portion 2A with the brake accommodating portion 12 (12B1 to 12B4).

Figure 13:
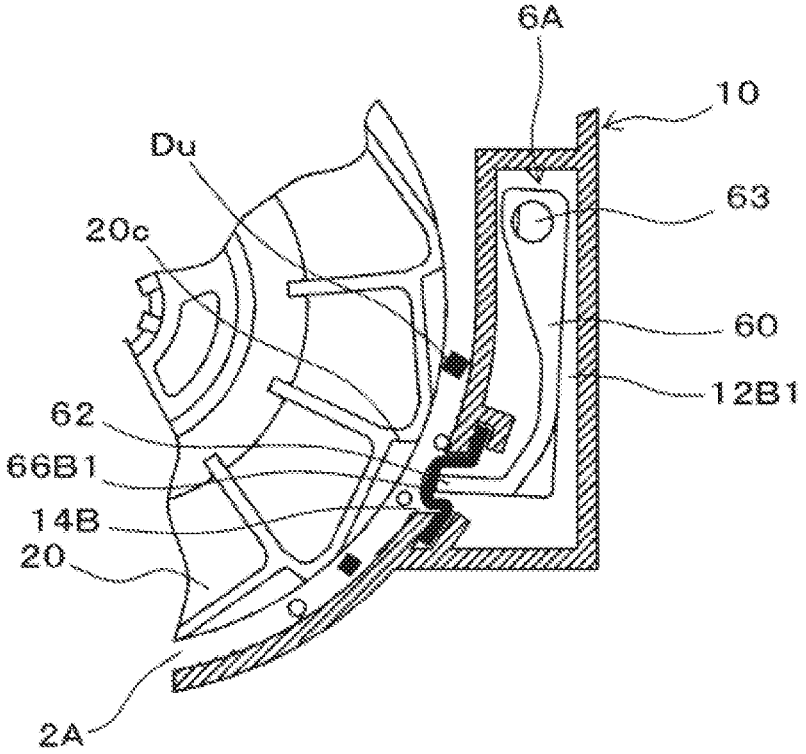
FIG. 13 is a view illustrating an example of a brake accommodating portion of a second embodiment provided in the reinforcing bar binding machine of the embodiment.

As illustrated in FIG. 13, the brake accommodating portion 12B1 of a first example of the second embodiment has a sealing member 66B1 at the third opening portion 14B provided in the moving path of the engaging portion 62. The sealing member 66B1 is an example of a shielding portion and has a member such as rubber capable of expanding or contracting by elastic deformation, a member capable of expanding or contracting with a bellows structure or the like, a member having sufficient flexibility with respect to the movement amount of reel brake 60 and capable of expanding or contracting by the amount of flexibility, or the like. The sealing member 66B1 has an outer shape that blocks the third opening portion 14B.

In the braking portion 6A, when the reel brake 60 moves to the braking position, the sealing member 66B1 is pushed and elastically deformed and both of the sealing member 66B1 and the engaging portion 62 protrude into the reel accommodating portion 2A, and then both of the sealing member 66B1 and the engaging portion 62 are engaged with the engaged portion 20*c* of the wire reel 20. Also, when the reel brake 60 moves to the retracting position, the engaging portion 62 retracts from the third opening portion 14B into the braking accommodation portion 12B1 and the sealing member 66B1 returns to its original shape.

In the brake accommodating portion 12B1 of the first example of the second embodiment, by providing the sealing member 66B1 in a shape that blocks the third opening portion 14B, the third opening portion 14B can be always blocked. Therefore, the example can prevent the foreign matter Du generated in the reel accommodating portion 2A and the foreign matter Du, moisture, or the like which enters the reel accommodating portion 2A from the outside, from entering the brake accommodating portion 12B1 through the third opening portion 14B. As a result, it is possible to suppress the occurrence of the operational failure of the reel brake 60. Further, since the sealing member 66B1 is formed of a flexible member, the sealing member 66B1 is prevented from interfering with the operation of the reel brake 60.

Figure 14:
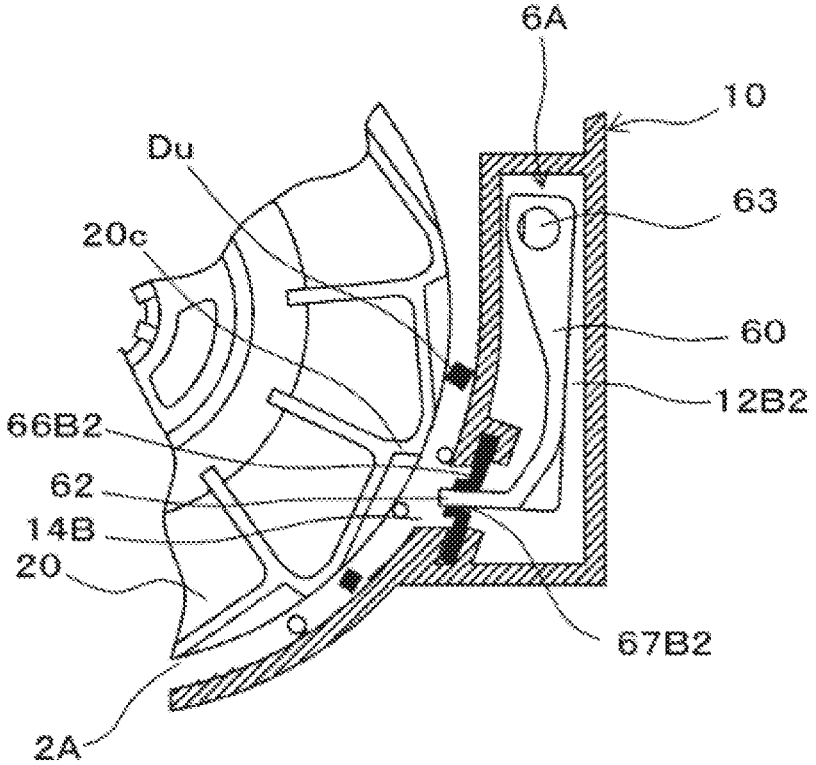
FIG. 14 is a view illustrating an example of the brake accommodating portion of the second embodiment provided in the reinforcing bar binding machine of the embodiment.

As illustrated in FIG. 14, the brake accommodating portion 12B2 of the second example of the second embodiment has a sealing member 66B2 between the third opening portion 14B and the engaging portion 62 of the reel brake 60. The sealing member 66B2 is an example of a shielding portion, is made of an elastic material such as rubber, has an outer shape that blocks the third opening portion 14B, and includes a sealing opening portion (a shielding opening portion) 67B2 through which the engaging portion 62 of the reel brake 60 passes. In the sealing opening portion 67B2, an opening sized to be in contact with the engaging portion 62 of the reel brake 60 or an opening sized such that a gap is formed between the sealing opening portion 67B2 and the engaging portion 62 of the reel brake 60 so as to suppress entry of the foreign matter Du is provided in accordance with the locus of the engaging portion 62 moved by the rotational movement of the reel brake 60 with the shaft 63 as the fulcrum.

When the reel brake 60 moves to the braking position, the braking portion 6A is configured such that the engaging portion 62 protrudes from the sealing opening portion 67B2 of the sealing member 66B2 into the reel accommodating portion 2A and engages with the engaged portion 20*c* of the wire reel 20. Also, when the reel brake 60 moves to the retracting position, the engaging portion 62 retracts from the third opening portion 14B into the brake accommodation portion 12B2.

In the brake accommodating portion 12B2 of a second example of the second embodiment, the sealing member 66B2 is provided in a shape that blocks a portion between the third opening portion 14B and the engaging portion 62 of the reel brake 60, and thus the example prevents the foreign matter Du, moisture, or the like from entering the brake accommodating portion 12B2 through the third opening portion 14B. As a result, the example suppresses the occurrence of the operational failure of the reel brake 60. In addition, the sealing member 66B2 is provided without interfering with the operation of the reel brake 60 by the sealing opening 67B2 through which the engaging portion 62 passes in the sealing member 66B2.

The sealing member 66B2 with an elastic material may have a structure in which the sealing member 66B2 and the engaging portion 62 are integrated with each other in a state where the sealing opening portion 67B2 and the engaging portion 62 are in contact with each other, or a structure in which the sealing member 66B2 and the engaging portion 62 are integrally formed by adhesion or the like, to be elastically deformed in the operation of the reel brake 60.

Figure 15:
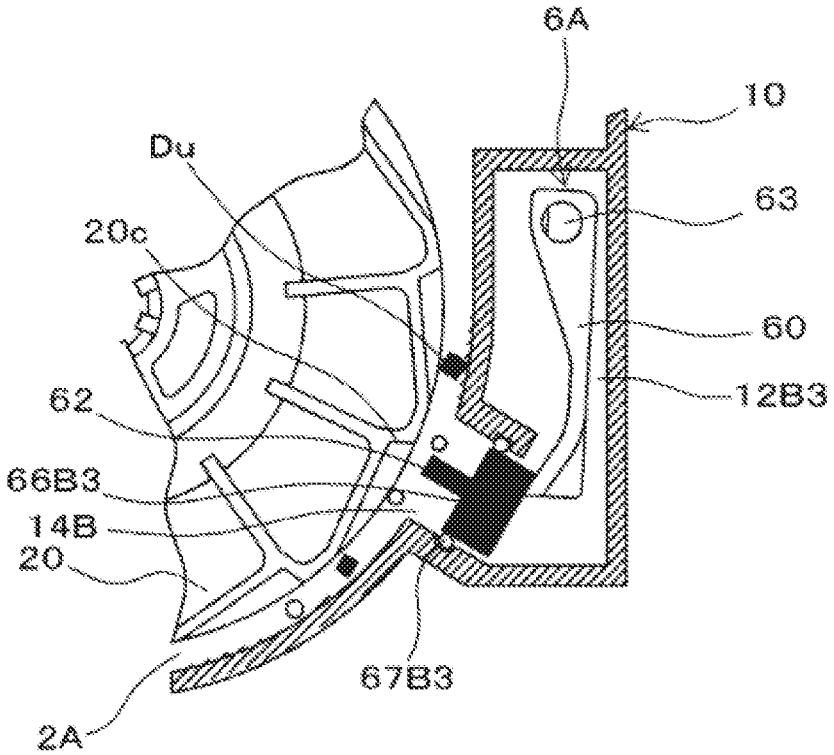
FIG. 15 is a view illustrating an example of the brake accommodating portion of the second embodiment provided in the reinforcing bar binding machine of the embodiment.

As illustrated in FIG. 15, a brake accommodating portion 12B3 of a third example of the second embodiment has a sealing member 66B3 which blocks the third opening portion 14B in the reel break 60. The sealing member 66B3 is an example of a shielding portion, is made of an elastic material such as rubber, and has an outer shape that blocks the third opening portion 14B. The engaging portion 62 is provided separately from the reel brake 60 and is provided in the sealing member 66B3. Also, the engaging portion 62 may be configured such that the engaging portion 62 provided in the reel brake 60 protrudes from the sealing member 66A3. The sealing member 66B3 has a size which is in contact with an inner peripheral surface of the third opening portion 14B or a size having a gap is formed between the sealing member 66B3 and the inner peripheral surface of the third opening portion 14B to suppress entry of the foreign matter Du, and the sealing member 66B3 blocks the third opening portion 14B in a predetermined sealing state where the assumed entry of the foreign matter Du can be prevented. Further, a sliding sealing member 67B3 which is in contact with an outer peripheral surface of the sealing member 66B3 may be provided on the inner peripheral surface of the third opening portion 14B. The sealing member 66B3 is configured to be movable relative to the third opening portion 14B along the moving direction of the reel brake 60 that causes the engaging portion 62 to protrude from the third opening portion 14B.

In the braking portion 6A, when the reel brake 60 moves to the braking position, the sealing member 66B3 is pushed by the reel brake 60 so that the engaging portion 62 protrudes into the reel accommodating portion 2A and engages with the engaged portion 20*c* of the wire reel 20. Also, when the reel brake 60 moves to the retracting position, the sealing member 66A3 returns to the third opening portion 14B and the engaging portion 62 retracts from the third opening portion 14B to the brake accommodation portion 12B3.

In the brake accommodating portion 12B3 of the third example of the second embodiment, by providing the sealing member 66B3 in the shape of blocking the third opening portion 14B in the reel brake 60, the example suppresses the foreign matter Du, moisture, or the like from entering the brake accommodation portion 12B3 through the third opening portion 14B. Therefore, the occurrence of the operational failure can be suppressed in the reel brake 60. Also, by providing the sealing member 66B3 in the reel brake 60, the sealing member 66B3 does not interfere with the operation of the reel brake 60.

Figure 16:
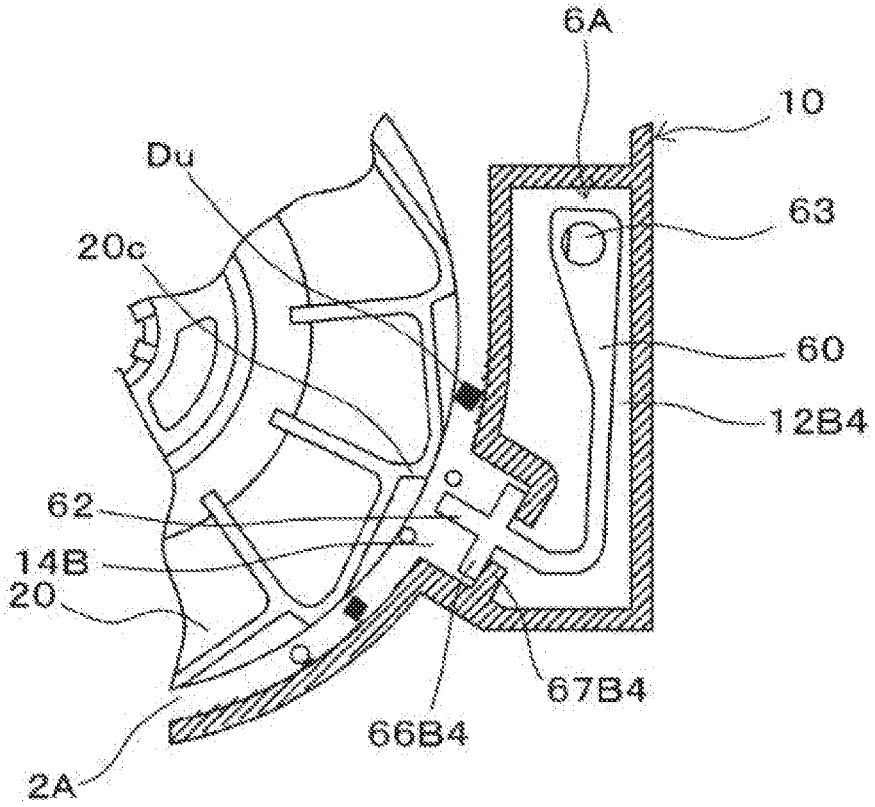
FIG. 16 is a view illustrating an example of the brake accommodating portion of the second embodiment provided in the reinforcing bar binding machine of the embodiment.

As illustrated in FIG. 16, the brake accommodating portion 12B4 of a fourth example of the second embodiment includes a third opening portion 14B. The reel brake 60 includes a sealing portion 66B4 which blocks the third opening portion 14B. The sealing portion 66B4 is an example of a shielding portion and has an outer shape that matches the shape of the third opening portion 14B. The third opening portion 14B includes an abutment portion 67B4 on which the sealing portion 66B4 abuts. The abutment portion 67B4 protrudes from the inner circumferential surface of the third opening portion 14B. When the sealing portion 66B4 abuts on the abutment portion 67B4, the third opening portion 14B is blocked in a predetermined sealing state where the assumed entry of the foreign matter Du can be prevented. The sealing portion 66B4 is configured to be movable relative to the third opening portion 14B along the moving direction of the reel brake 60 that causes the engaging portion 62 to protrude from the third opening portion 14B. In the reel brake 60, the engaging portion 62 protrudes from the sealing portion 66B4.

When the reel brake 60 moves to the braking position, in the braking portion 6A, the engaging portion 62 protrudes into the reel accommodating portion 2A and engages with the engaged portion 20*c* of the wire reel 20 in a state where the sealing portion 66B4 seals the third opening portion 14B. Further, when the reel brake 60 moves to the retracting position, the sealing portion 66B4 abuts on the abutment portion 67B4, and in a state where the sealing portion 66B4 seals the third opening portion 14B, the engaging portion 62 is retracted from third opening portion 14B to the brake accommodating portion 12B4.

In the brake accommodating portion 12B4 of the fourth example of the second embodiment, by providing the sealing portion 66B4 in a shape that blocks the third opening portion 14B in the reel brake 60, the example prevents the foreign matter Du, moisture, or the like from entering the brake accommodating portion 12B4 through the third opening portion 14B. Therefore, the occurrence of the operational failure of the reel brake 60 can be suppressed. Also, by providing the sealing portion 66B4 in the reel brake 60, the sealing portion 66B4 does not interfere with the operation of the reel brake 60.

The invention claimed is:

1. A binding machine, comprising:

a reel accommodating portion that is configured to rotatably accommodate a wire reel;

a reel brake that has an engaging portion which is configured to directly engage with the wire reel and which is configured to brake rotation of the wire reel; and a brake accommodating portion that covers a periphery of the reel brake except at least the engaging portion, wherein the brake accommodating portion includes a first opening portion exposing the engaging portion and a second opening portion communicating an inside of the brake accommodating portion with an outside of the brake accommodating portion.

2. The binding machine according to claim 1, further comprising:

a main body portion; and a handle portion that protrudes from the main body portion, wherein the second opening portion opens in a same direction as a protruding direction of the handle portion.

3. The binding machine according to claim 1, wherein the second opening portion is openable and closable.

4. The binding machine according to claim 3, further comprising:

a lid portion that is configured to open and close the second opening portion.

5. The binding machine according to claim 4, wherein the lid portion is formed in a concave shape which is configured to accommodate foreign matter.

6. The binding machine according to claim 4, wherein the lid portion is provided in the reel brake and opens and closes the second opening portion in conjunction with an operation of the reel brake.

7. The binding machine according, to claim 1, wherein the engaging portion is movable between a first position where the engaging portion engages with the wire reel and a second position where the engaging portion disengaged from the wire reel, and the reel brake opens the second opening portion when the engaging portion is located at the first position, and the reel brake closes the second opening portion when the engaging portion is located at the second position.

8. The binding machine according to claim 1, further comprising:

a fan that is configured to generate air flow, wherein the brake accommodating portion has an inlet of air in communication with the fan.

9. The binding machine according to claim 1, wherein the engaging portion directly engages the wire reel through the first opening portion, and foreign matter is discharged from the brake accommodating portion through the second opening portion.

10. The binding machine according to claim 9, wherein the second opening portion is located at a bottom of the brake accommodating portion such that foreign matter is discharged from the brake accommodating portion by weight of the foreign matter.

11. The binding machine according to claim 9, wherein the engaging portion is movable between a retracted position in which the engaging portion is inside the brake accommodating portion and a braked position in which the engaging portion extends through the first opening portion and into the reel accommodating portion to directly engage the wire reel.

12. The binding machine according to claim 1, wherein the engaging portion is movable between a retracted position in which the engaging portion is inside the brake accommodating portion and a braked position in which the engaging portion extends through the first opening portion and into the reel accommodating portion to directly engage the wire reel.

13. A binding machine, comprising:

a reel accommodating portion that is configured to rotatably accommodate a wire reel;

a reel brake that has an engaging portion which is configured to directly engage with the wire reel and which is configured to brake rotation of the wire reel; and a brake accommodating portion that covers a periphery of the reel brake, wherein the brake accommodating portion includes an opening portion which is provided on a moving path of the engaging portion and which communicates the reel accommodating portion with the brake accommodating portion, and the opening portion includes a shielding portion which is configured to block the opening portion in a state where the engaging portion engages with the wire reel.

14. The binding machine according to claim 13, wherein the shielding portion includes a flexible member covering the opening portion.

15. The binding machine according to claim 13, wherein the shielding portion includes a shielding opening portion through which the engaging portion passes.

16. The binding machine according to claim 13, wherein the shielding portion has a shape which matches the third opening portion and moves along a moving direction of the engaging portion.

17. The binding machine according to claim 13, wherein the engaging portion is movable between a retracted position and a braked position, in the retracted position the engaging portion is retracted in the brake accommodating portion, and in the braked position the engaging portion is moved toward the wire reel to directly engage the wire reel by at least one of:

(i) the engaging portion contacting the wire reel, or (ii) the engaging portion urging the shielding portion toward the wire reel such that the shielding portion contacts the wire reel and the engaging portion directly engages the wire reel with the shielding portion between the wire reel and the engaging portion.

* * * * *